US006722551B2

(12) United States Patent
Weibel et al.

(10) Patent No.: US 6,722,551 B2
(45) Date of Patent: Apr. 20, 2004

(54) SETTING TOOL

(75) Inventors: Michael Weibel, Wil (CH); Stefan Bönig, Wasserburg (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/465,259

(22) Filed: Jun. 19, 2003

(65) Prior Publication Data

US 2003/0234270 A1 Dec. 25, 2003

(30) Foreign Application Priority Data

Jun. 24, 2002 (DE) ..... 102 28 036

(51) Int. Cl.[7] ..... B25C 1/04
(52) U.S. Cl. ..... 227/10; 227/120; 227/136
(58) Field of Search ..... 227/9, 10, 130, 227/120, 119, 136, 135

(56) References Cited

U.S. PATENT DOCUMENTS 4,858,811 A * 8/1989 Brosius et al. ..... 227/10
4,930,673 A * 6/1990 Pfister ..... 227/10
5,597,972 A * 1/1997 Wachter ..... 89/1.14
5,829,661 A * 11/1998 Hirtl et al. ..... 227/10
6,138,887 A * 10/2000 Nayrac et al. ..... 227/8
6,158,643 A * 12/2000 Phillips ..... 227/130
6,223,966 B1 * 5/2001 Nayrac et al. ..... 227/130
6,378,752 B1 * 4/2002 Gaudron ..... 227/10

* cited by examiner

*Primary Examiner*—Scott A. Smith
(74) *Attorney, Agent, or Firm*—Sidley Austin Brown & Wood, LLP

(57) ABSTRACT

A setting tool for driving in fastening element includes a bolt guide (12) axially displaceably arranged in the tool housing (11), a magazine (15) projecting sidewise from the bolt guide (12) and displaceable in a direction opposite the setting direction (40) against a biasing force of a first spring (22) relative to the bolt guide (12), a second spring located between the housing (11) and the magazine (15) and having a maximal biasing force acting in the setting direction (40) and an excursion greater than a maximal biasing force and an excursion of the first spring (22); and an annular element (23) which surrounds the piston guide (13) of the tool and is located in a receiving space (20) formed in the housing (11) for transmitting a biasing force of the second spring (21) to at least one engagement surface (19) provided on the magazine (15).

3 Claims, 6 Drawing Sheets

SETTING TOOL

BACKGROUND OF THE INVENTION

1. Field of the Invention

The present invention relates to a setting tool, in particular, to an expandable gas-driven setting tool for driving fastening elements, such as bolts, nails and the like in a constructional component and including a housing, a bolt guide axially displaceably arranged in the housing, a magazine for the fastening elements projecting sidewise from the bolt guide and displaceable in a direction opposite the setting direction against a biasing force of a first spring relative to the bolt guide, a second spring located between the housing and the magazine and having a maximal biasing force acting in the setting direction and an excursion greater than a maximal biasing force and an excursion of the first spring, and a piston guide axially displaceably arranged in the housing.

2. Description of the Prior Art

European Publication EP-0 743 141 B1 discloses an explosive powder charge-operated setting tool having a housing and an axially displaceable bolt guide arranged in the housing and projecting beyond the housing in a setting direction. A magazine for fastening elements is suspended sidewise from the bolt guide. The magazine is displaced relative to the bolt guide in a direction opposite the setting direction against a spring-biasing force. The magazine provides for storing of a plurality of fastening elements, such as bolts or nails, which are located in guide sleeves connected with each other in a belt-like manner, and for advancing of the fastening elements into the bolt guide. The fastening elements are displaced in a direction toward the bolt guide with a spring-biased slide located in the magazine. On the magazine, there is provided a pin that is supported against the magazine with a spring and is pressed toward the tool housing when the setting tool is pressed against a constructional component. The bolt guide is so displaced that the displacement of the fastening elements is blocked. The maximal biasing force applied to the pin and the corresponding spring excursion of the spring are greater than the spring-biasing force and excursion of a spring located between the bolt guide and magazine. This is necessary to insure the forward movement of the fastening elements located in the magazine.

For actuating the setting tool, the housing should be displaced relative to the bolt guide over a certain so-called "press-on path." To this end, in a first stage of the press-on displacement, a setting direction-side, press-on surface of the bolt guide is set against a constructional component, and the housing is pressed in the setting direction. During the press-on step, the magazine is displaced in the setting direction relative the bolt guide until the magazine abuts the constructional component. The spring, which is arranged between the housing and the magazine, reaches during the first press-on phase or stage, the setting direction-side, end surface of the housing and displaces the magazine, because of its greater biasing force and excursion, relative to the bolt guide in the setting direction until the magazine contacts the constructional component. At the same time, the spring, which is located between the bolt guide and the magazine, becomes preloaded. In this position of the magazine, the advancement of the fastening elements from the magazine into the bold guide is prevented. After the setting process, when the setting tool is lifted off the constructional component, first, the magazine, the bolt guide, and the piston guide are displaced together relative to the housing. Only, when the magazine and the bolt guide have been displaced relative to the housing so far that the spring or the pin does not contact the housing anymore, the displacement of the magazine relative to the bolt guide takes place under the biasing force of the spring arranged between the bolt guide and the magazine, until the magazine reaches its initial position. In this way, the lifting off the displacement blocking means takes place with a time delay.

The drawback of the known setting tool consists in that the pin, which is not arranged coaxially with the press-on direction, applies a torque to the displacement parts, in particular to the magazine. This leads to an asymmetrical load and, as a result, to jamming of the movable parts.

Accordingly, an object of the present invention is to so modify a setting tool of the type discussed above that a reliable forward displacement of the fastening elements is insured, and the above-noted drawbacks are eliminated.

SUMMARY OF THE INVENTION

This and other objects of the present invention, which will become apparent hereinafter, are achieved by providing, on the magazine, at least one engaging surface that at least partially surrounds the bolt guide, and by providing an annular element circumferentially surrounding the piston guide and located in a receiving space formed in the housing for transmitting a biasing force of the spring which is located between the magazine and the housing to the at least one engagement surface of the magazine upon the setting tool being pressed against the constructional component.

The annular element is arranged coaxially with the press-on or setting direction.

These novel features of the present invention permits to pivot the magazine with the bolt guide by 360° as its cooperation with the annular element and, thereby, a forward advancement is possible in any pivotal position. Further, the application of force to the movable parts during the press-on stage takes place symmetrically, which prevents jamming of the movable parts, and no decrease of the press-on force because of jamming takes place.

The annular element, which is guided in the front, setting direction-side, of the housing, is biased in the setting direction by a compression spring likewise coaxially arranged with respect to the setting direction. The compression spring is supported against the housing or a sleeve fixedly secured in the housing.

Advantageously, the receiving space is formed as a socket in which both the annular element and compression spring are arranged. A stop in the housing can prevent the annular element from falling out of the housing. These measures permit to provide a compact and easy to assemble setting tool.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENTS

Figure 1:
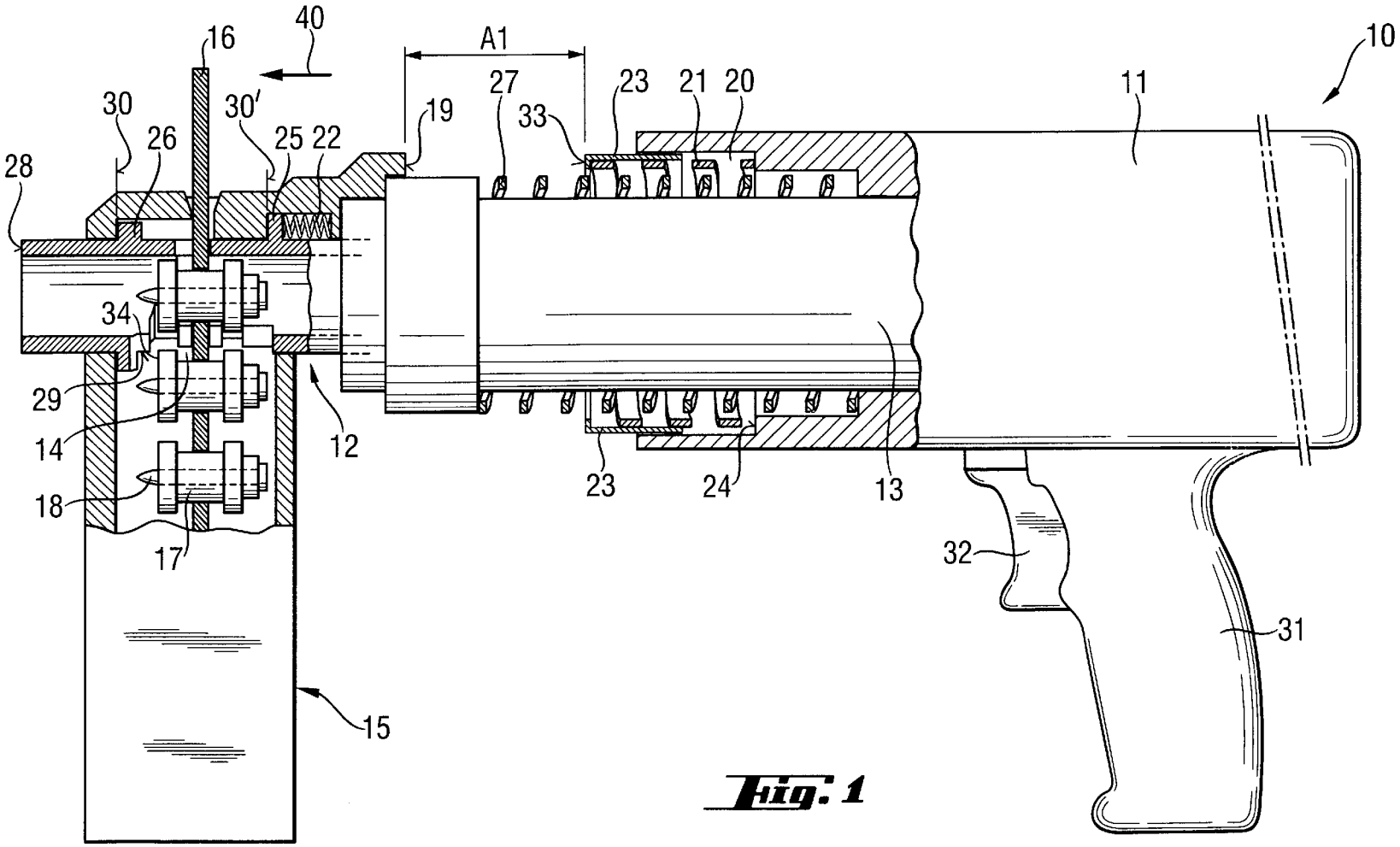
FIG. 1 a side, partially cross-sectional view of a setting tool according to the present invention in its initial position.
Figure 2:
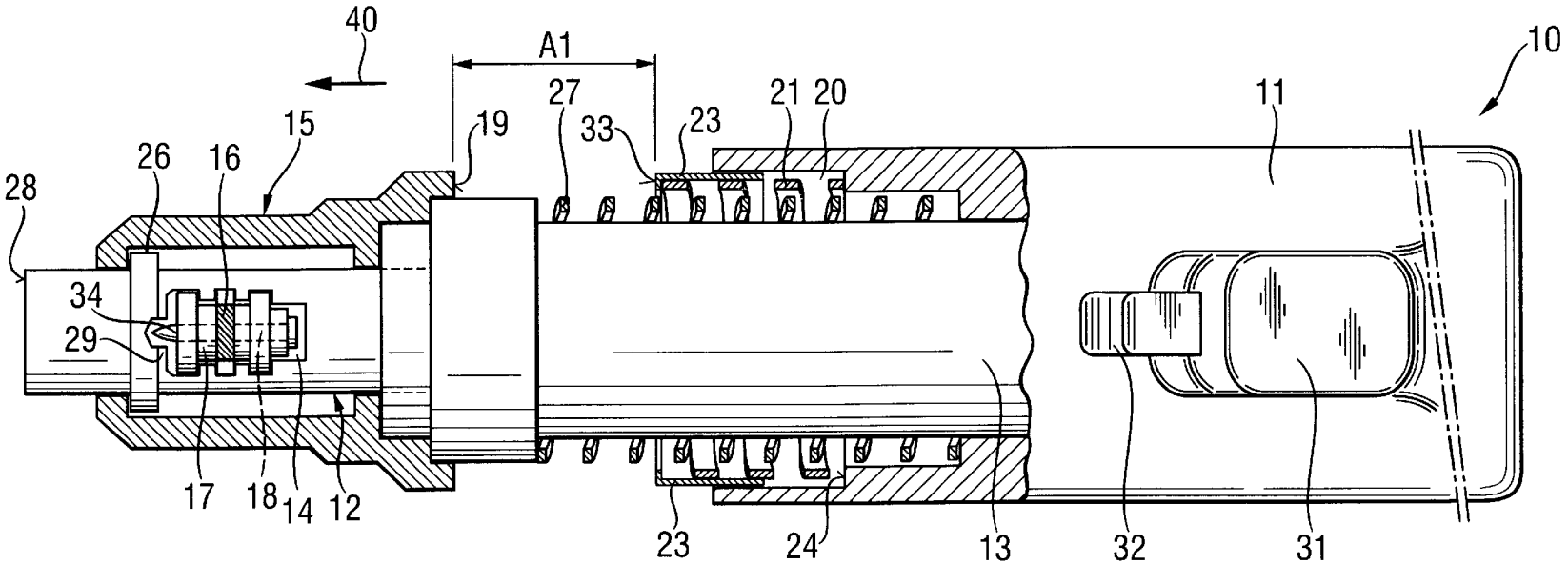
FIG. 2 a bottom, partially cross-sectional view of the setting tool show in FIG. 1.

A setting tool 10 according to the present invention, which is shown in FIGS. 1–2 in its initial position, has a housing 11, a bolt guide 12 projecting beyond the housing 11 in a setting direction 40, and a handle 31 extending downward from the housing. On the handle 31, there is provided an actuation switch 32 or trigger for initiating a setting process.

The setting tool 10 can be driven, e.g., with propellant charges arranged on a displaceable carrier strip, not shown in the drawings e.g., with the setting tool being arranged on a mount, the housing 11 can also have two, movable relative to each other parts.

A magazine 15 for fastening elements 18 and displaceable in an axial direction is arranged on the bolt guide 12. The fastening elements 18 are carried by a belt-shaped magazine strip 16, with the fastening elements 18 being arranged in respective separate guide elements 17. The displacement of the fastening elements 18 in a direction toward the bolt guide 12 takes place in the magazine 15 automatically by a spring-biased transportation carriage, not shown, displaceable along a guide in the magazine 15. The fastening elements 18 are advanced from the magazine 15 into the bolt guide 12 through a side opening 14. In the housing 11, there is further provided a displaceable piston guide 13 that is supported in the housing 11 by a spring 27. A percussion piston, not shown, is displaceably arranged in the piston guide 13. The percussion piston drives a fastening element 18 in a constructional component after actuation of the switch 32 and ignition of a propellant charge.

The magazine 15 is so formed that it circumferentially surrounds the bolt guide 12 at least regionwise. At the end of the magazine 15 adjacent to the housing 11, there is provided an engagement surface 19 that is formed as annular surface, at least regionwise, and that surrounds the setting direction end of the piston guide 13. The engagement surface 19 can be completely circular or be regionwise interrupted. The function of the engagement surface 19 will be explained in detail further below.

In a recess of the magazine 15 adjacent to the bolt guide 12, there is arranged a spring 22 supported at its opposite ends against the magazine 15 and a projection 25 provided on the bolt guide 12. The bolt guide 12 has another projection 26 which is supported, in the initial position of the setting tool 10, against a stop surface 30 of the magazine 15, as shown in FIG. 1. The spring 22 biases the projections 25, 26 against the respective stop surfaces 30' 30 of the magazine 15.

The front, in the setting direction 40, end surface of the bolt guide 12, defines a press-on surface 28 that is pressed against a constructional component U. The bolt guide 12 is further provided with a locking edge 29 located at the end of the opening 14 through which a fastening element 18 is advanced into the bolt guide 12. The locking edge 29 can prevent the displacement of the fastening element 18 and of the magazine strip 16 even in a completely press-on condition of the setting tool 10, as it will be explained in detail further below.

The magazine 15 can be connected with the bolt guide 12 without a possibility of rotation relative thereto, and the unit formed of bolt guide 12 and the magazine 15 can be rotated with respect to the piston guide 13. In this case, it becomes possible to displace the magazine 15 with respect to the handle 31 of the setting tool 10, e.g., by 180°.

At the setting direction end of the housing 1, there is provided a cylindrical receiving space 20 defining, at its end adjacent to the housing 11, a support surface 24 against which a second spring 21 is supported. The second spring 21 that surrounds the piston guide 13 and a spring 27 which circumferentially surrounds the piston guide 13. The front end of the second spring 21 is closed with an annular element 23 displaceably arranged in the receiving space 20.

The annular element 23 can be pressed into the receiving space 20 against a biasing force of the spring 21.

Figure 3:
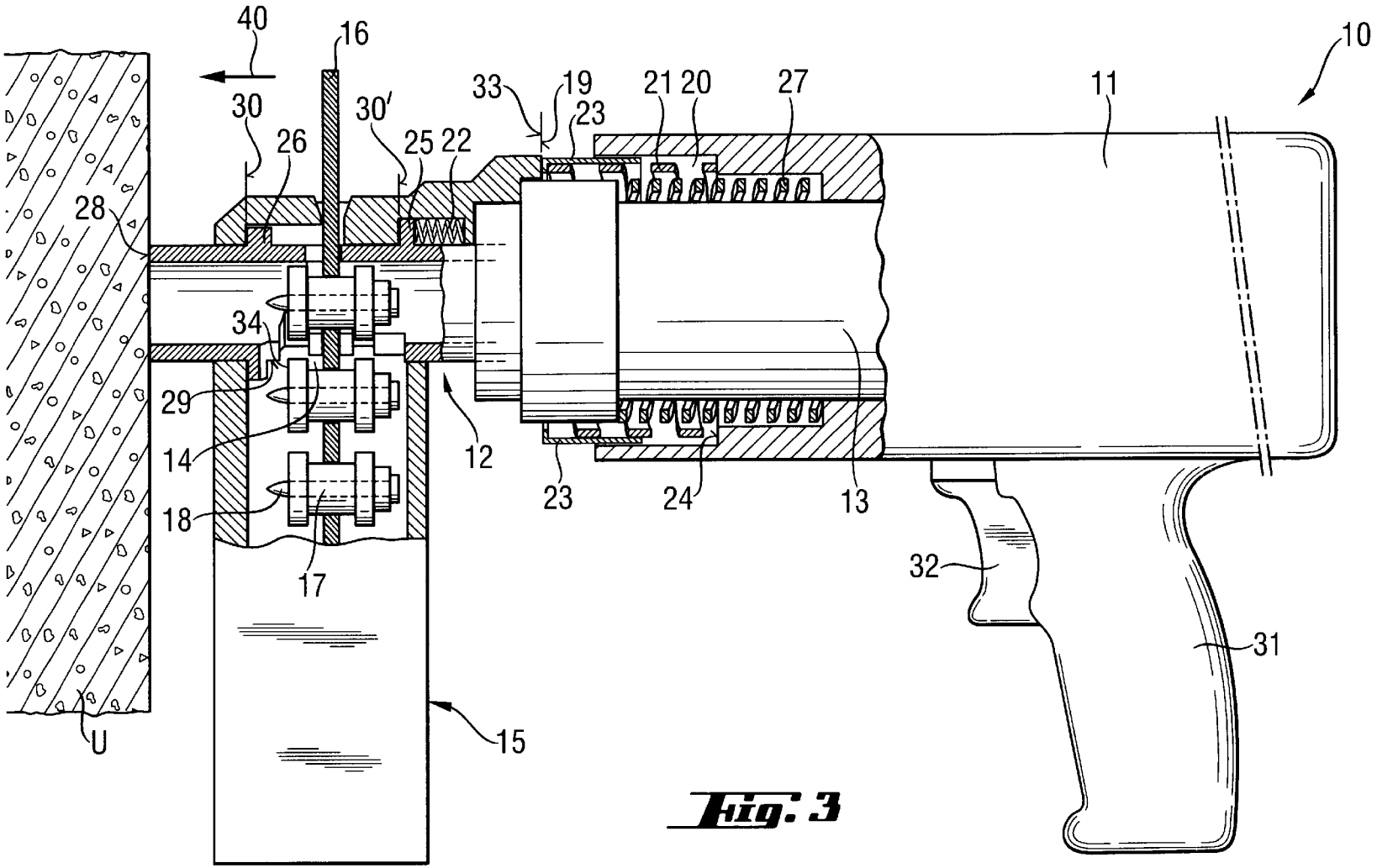
FIG. 3 a side, partially cross-sectional view of the setting tool shown in FIG. 1 in a first partially press-on position.

To make the actuation of the setting tool 10 possible, the bolt guide 12 and the piston guide 13, which adjoins the bolt guide 12, should be displaced relative to the housing 11 over a press-on path A1 through A3 in order to cock the ignition device, not shown, which is arranged in the rear of the housing 11 and to be able to actuate the switch 32. To this end, as shown in FIG. 3, the press-on surface 28 of the bolt guide 12 is set against the constructional component U, and the housing 11 is pressed against the constructional component U in the setting direction 40. In FIG. 3, the setting tool 10 has already been displaced over a press-on path A1 against the construction component U (see FIGS. 1 and 2). The press-on path A1 is defined by a distance between an engagement surface 19 and a stop surface 33. With the setting tool 10 being displaced over the press-on path A1, the piston guide 13 is displaced against the biasing force of the spring 27 into the housing 11, with the spring 27 being compressed by a respective length. In this position of the setting tool 10, the position of the bolt guide 12 with respect to the magazine 15 remains unchanged. The annular element 23 only engages, with its setting direction stop surface 33, the engagement surface 19 of the magazine 15 under action of the biasing force of the spring 21.

Figure 4:
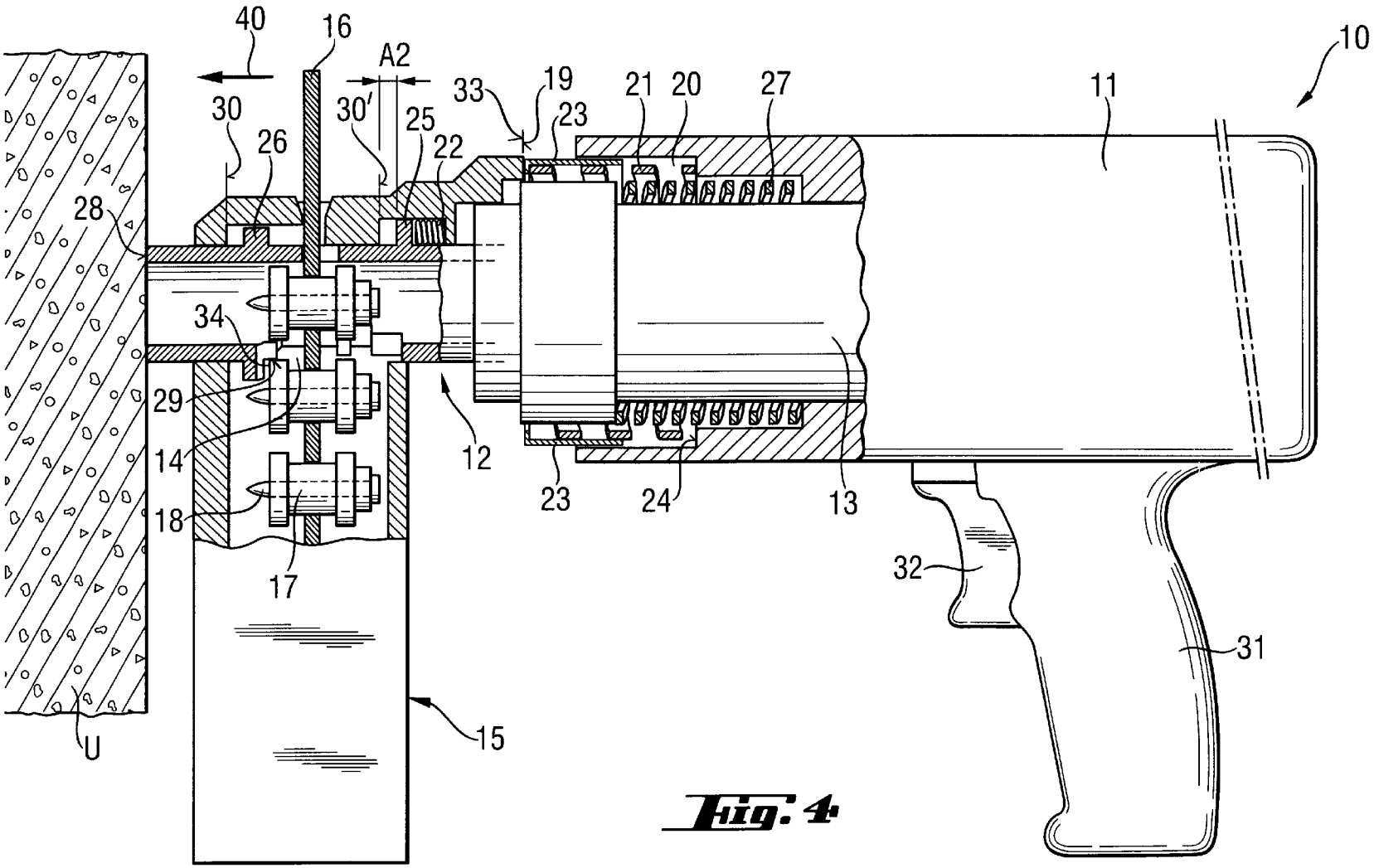
FIG. 4 a side, partially cross-sectional view of the setting tool shown in FIG. 1 in a second partially press-on position.
Figure 5:
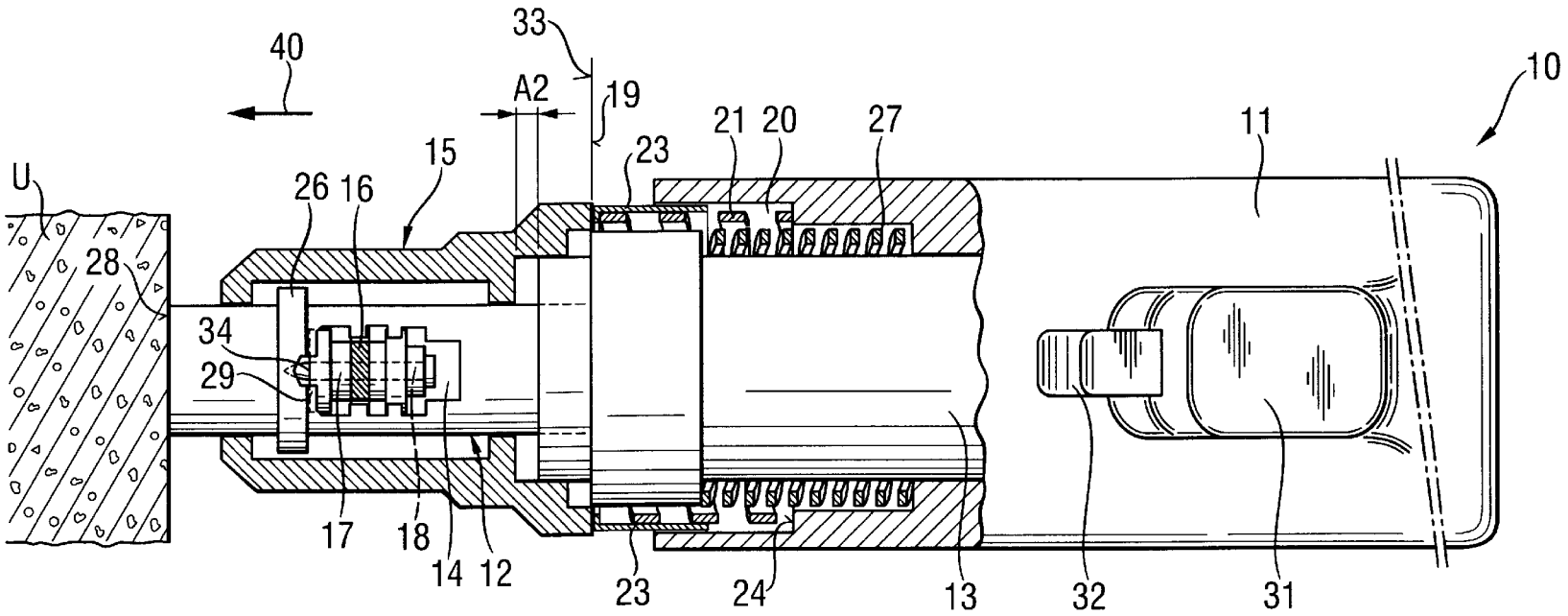
FIG. 5 a bottom, partially cross-sectional view of the setting tool of FIG. 1 in a second partially press-on position.

In FIGS. 4–5, the setting tool 10 is displaced further over a press-on path A2 in the setting direction 40 and remains pressed against the constructional component U. In this position of the setting tool 10, the bolt guide 12 is displaced relative to the magazine 15 by the biasing force of the spring 22. As a result, the locking edge 29 is so displaced (see FIG. 5) that it prevents displacement of the magazine strip 16 or the guide elements 17 as it overlaps the end 34 of the uppermost guide element 17. At that, the initial condition of the spring 21 remains unchanged as the biasing force of the spring 21 is greater than that of spring 22.

Figure 6:
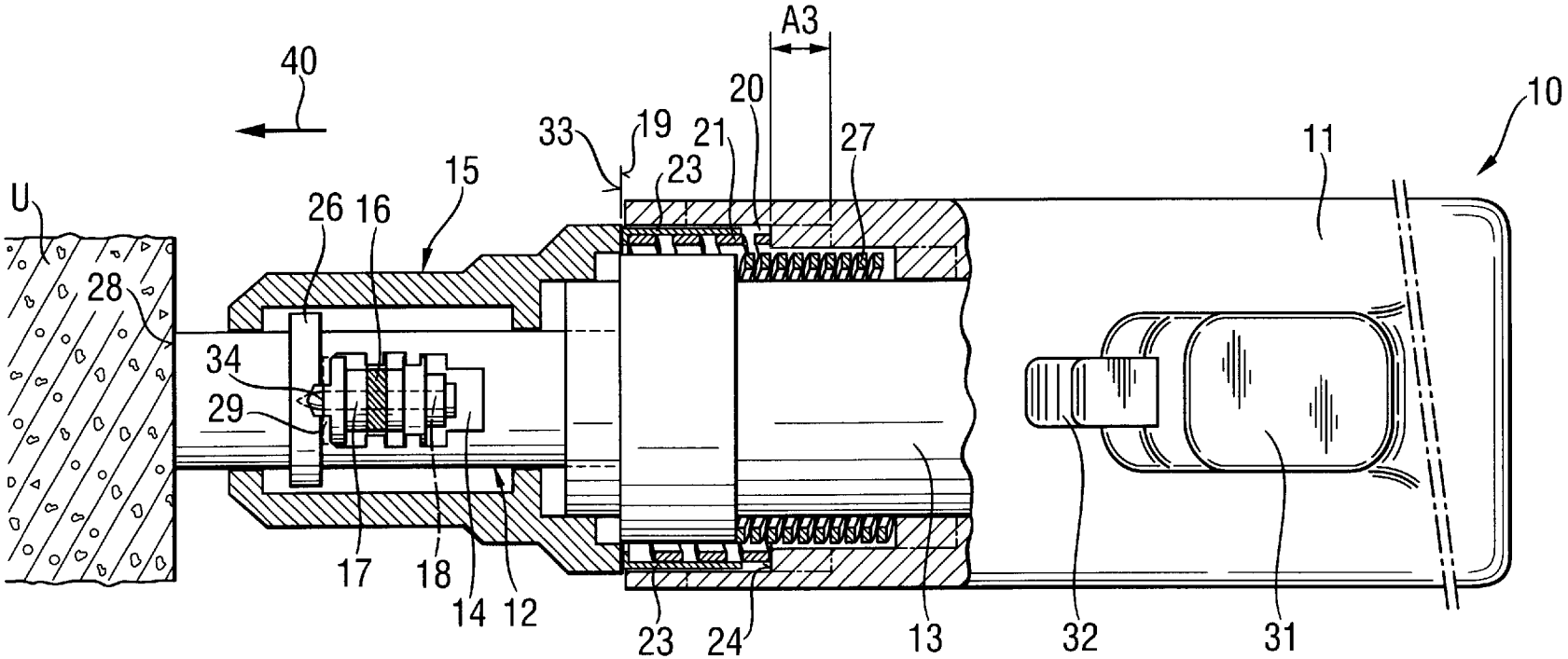
FIG. 6 a bottom, partially cross-sectional view of the setting tool of FIG. 1 in a completely press-on position.

In FIG. 6, the setting tool 10 is displaced further over a distance A3 in the setting direction 40 against the constructional component U. Upon displacement of the setting tool 10 over the path A3, the annular element 23 is displaced against the biasing force of the 21 into the receiving space 20 in the housing 11. Only in the position of the setting tool 10 shown in FIG. 6, the setting process can be initiated by the actuation of the switch 32. When the setting tool 10 is lifted off the constructional component U, the springs 21, 22, 27 act in a reverse, in comparison with the press-on step, order, displacing the corresponding components of the setting tool 10 in the setting direction 40.

Upon lifting off the setting tool 10 over the path A3, the magazine 15 is pressed away from the housing 11 by the annular element 23 and the spring 21 that applies a biasing force to the annular element 23 into the position shown in FIGS. 4–5. The displacement of the magazine strip 15 in this position of the setting tool 10 is prevented as the locking edge 29 of the bolt guide 12 is located between two guide elements 17, so that the displacement of the magazine strip 17 is blocked. Thus, the forward movement of the magazine strip 16, during the lifting of the setting tool 10, is prevented. If the magazine 15 and the bolt guide 12 are pivoted with respect to the piston guide 13 by 180°, when the unit of the magazine 15 and the bolt guide 12 is pivotally arranged relative to the piston guide, this effect is still available. This is because a contact between the annular element 23 and the engagement surface 19 of the magazine 15 is insured due to the annular shape, at least regionwise, of the engagement surface 19 and the annular element 23. Only after the setting tool 10 has been lifted over the path A2 to the position showing FIG. 3, the locking edge 29 is displaced out of the displacement path of the magazine strip 19. The bolt guide 12 is displaced relative to the magazine 15 by the spring 22, so that the projections 25, 26 again abut the stop surfaces 30', 30 of the magazine 15, respectively.

Upon a complete lifting of the setting tool 10 over the path A1, the setting tool 10 returns into its initial position shown in FIGS. 1–2.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A setting tool for driving fastening elements in a constructional component, comprising a housing (11); a bolt guide (12) axially displaceably arranged in the housing (11); a magazine (15) for the fastening elements (16) projecting sidewise from the bolt guide (12) and displaceable in a direction opposite the setting direction (40) against a biasing force of a first spring (22) relative to the bolt guide (12), the magazine having at least one engagement surface (19) at least partially circumferentially surrounding the bolt guide (12); a second spring (21) located between the housing (11) and the magazine (15) and having a maximal biasing force acting in the setting direction (40) and an excursion greater than a maximal biasing force and an excursion of the first spring (22); a piston guide (13) axially displaceably arranged in the housing (11); and an annular element (23) circumferentially surrounding the piston guide (13) and located in a receiving space (20) formed in the housing (11) for transmitting a biasing force of the second spring (21) to the at least one engagement surface (19) of the magazine (15) upon the setting tool (10) being pressed against the constructional component (U).

2. A setting tool according to claim 1, wherein the receiving space (20) is formed as a socket in which both the second spring (21), which is formed as a helical spring, and the annular element (23), which projects past the second spring (21) in the setting direction, are located.

3. A setting tool according to claim 1, wherein the engagement surface (19) o the magazine (15) is formed as a ring interrupted at least in one location.

* * * * *